US010096441B2

(12) United States Patent
Kitamura et al.

(10) Patent No.: US 10,096,441 B2
(45) Date of Patent: Oct. 9, 2018

(54) ELECTRONIC APPARATUS HAVING A SWITCH DEVICE

(71) Applicant: LENOVO (SINGAPORE) PTE. LTD., Singapore (SG)

(72) Inventors: Masahiro Kitamura, Kanagawa-ken (JP); Takane Fujino, Kanagawa-ken (JP); Mitsuo Horiuchi, Kanagawa-ken (JP)

(73) Assignee: LENOVO (SINGAPORE) PTE LTD, Singapore (SG)

( * ) Notice: Subject to any disclaimer, the term of this patent is extended or adjusted under 35 U.S.C. 154(b) by 0 days.

(21) Appl. No.: 15/349,869

(22) Filed: Nov. 11, 2016

(65) Prior Publication Data

US 2017/0140883 A1 May 18, 2017

(30) Foreign Application Priority Data

Nov. 13, 2015 (JP) ..... 2015-223171

(51) Int. Cl.
*H01H 9/26* (2006.01)
*H01H 13/702* (2006.01)
*H01H 13/10* (2006.01)

(52) U.S. Cl.
CPC ..... *H01H 13/702* (2013.01); *H01H 13/10* (2013.01); *H01H 2201/034* (2013.01); *H01H 2203/036* (2013.01); *H01H 2205/004* (2013.01); *H01H 2209/002* (2013.01); *H01H 2209/034* (2013.01); *H01H 2209/078* (2013.01); *H01H 2223/042* (2013.01); *H01H 2239/074* (2013.01)

(58) Field of Classification Search
CPC ..... H01H 13/702; H01H 13/10; H01H 2203/034; H01H 2205/004; H01H 2203/042; H01H 2239/074
USPC ..... 200/5 A
See application file for complete search history.

(56) References Cited

U.S. PATENT DOCUMENTS 5,924,555 A 7/1999 Sadamori et al.
7,064,288 B2 * 6/2006 Nam ..... H01H 13/7006 200/314

(Continued)

FOREIGN PATENT DOCUMENTS

CN 1988088 A 6/2007
CN 201608076 U 10/2010

(Continued)

OTHER PUBLICATIONS

JP2011-040320A, Aihara, Feb. 2011 (machine translation).*

*Primary Examiner* — Kyung Lee
(74) *Attorney, Agent, or Firm* — Russell Ng PLLC; Antony P. Ng

(57) ABSTRACT

An electronic apparatus having a switch device capable of suppressing collision noise is disclosed. The switch device is equipped with a first fixed contact and a second fixed contact, and a metal dome that serves as a movable contact movable in a direction to be contacted with or separated from the first fixed contact. In a configuration in which the metal dome is moved to provide an electrical contact or a separation between the metal dome and the first fixed contact, whereby the first fixed contact and the second fixed contact are electrically connected therebetween, a conductive layer made of an anisotropic conductive sheet is provided between the first fixed contact and the metal dome.

20 Claims, 9 Drawing Sheets

(56) References Cited

U.S. PATENT DOCUMENTS

| | | | | |
|---|---|---|---|---|
| 7,075,025 | B2 * | 7/2006 | Tomitsuka | H01H 13/7006 200/512 |
| 8,362,381 | B2 * | 1/2013 | Itou | H01H 13/705 200/512 |
| 8,759,704 | B2 * | 6/2014 | Inamoto | H01H 13/85 200/406 |
| 9,177,738 | B2 * | 11/2015 | Park | H01H 13/7057 |
| 2003/0160669 | A1 * | 8/2003 | Trandafir | H01H 13/702 335/78 |
| 2007/0039809 | A1 * | 2/2007 | Aihara | H01H 13/83 200/310 |
| 2008/0142350 | A1 * | 6/2008 | Karaki | H01H 13/702 200/512 |
| 2008/0283380 | A1 * | 11/2008 | Tanabe | G01L 1/20 200/511 |
| 2009/0045039 | A1 * | 2/2009 | Hayashi | B81B 3/0054 200/238 |
| 2009/0266699 | A1 * | 10/2009 | Rothkopf | H01H 13/48 200/534 |
| 2011/0011715 | A1 * | 1/2011 | Itou | H01H 13/705 200/517 |
| 2015/0008113 | A1 * | 1/2015 | Liu | H01H 13/10 200/515 |
| 2015/0083562 | A1 * | 3/2015 | Hsu | H01H 13/14 200/344 |
| 2016/0379775 | A1 * | 12/2016 | Leong | H01H 13/10 200/5 A |

FOREIGN PATENT DOCUMENTS

| | | | |
|---|---|---|---|
| JP | 54-127625 | A | 10/1979 |
| JP | S6481131 | A | 3/1989 |
| JP | 05-043436 | | 6/1993 |
| JP | 2006032255 | A | 2/2006 |
| JP | 2007179921 | A | 7/2007 |
| JP | 2010015793 | A | 1/2010 |
| JP | 2010-123367 | A | 6/2010 |
| JP | 2011-040320 | | 2/2011 |
| WO | 2014175446 | A1 | 10/2014 |

* cited by examiner

ELECTRONIC APPARATUS HAVING A SWITCH DEVICE

PRIORITY CLAIM

The present application claims benefit of priority under 35 U.S.C. §§ 120, 365 to the previously filed Japanese Patent Application No. JP2015-223171 with a priority date of Nov. 13, 2015, which is incorporated by reference herein.

TECHNICAL FIELD

The present invention relates to electronic apparatuses in general, and in particular to an electronic apparatus having a switch device.

BACKGROUND

Many electronic apparatuses, such as a laptop PC, a cellular phone, etc., employ a switch device as an input button. A metal dome switch device, for example, uses two fixed contacts arranged on a substrate so as to be apart from each other, and a metal dome to serve as a movable contact. The metal done is elastically deformed by its depression operation in order to make the two fixed contacts conductive therebetween.

In the above-mentioned switch device, collisions between metals occur between the metal dome inverted by being elastically deformed when the switch is turned on, and each fixed contact can generate a loud collision sound. The loud sound is typically not a problem when an electronic apparatus is being used at home or the like, but it may become a problem when the electronic apparatus is being used in a public place such as a library, a coffee shop, etc.

Thus, it would be desirable to reduce the collision sound of a switch device, especially when the switch device is being used as a detection switch for a key operation of a keyboard and a detection switch for a depression operation of a clickable touch pad because the usage frequency of detection switches is generally quite high.

SUMMARY

In accordance with an embodiment of the present disclosure, a switch device is equipped with a fixed contact and a movable contact movable in a direction to be contacted with or separated from the fixed contact, and in which the movable contact is moved to provide electrical contact/separation between the movable contact and the fixed contact. The switch device is provided with a conductive layer between the fixed contact and the movable contact.

With the above-mentioned configuration, it is possible to absorb and prevent the generation of sound by collisions between metals between the fixed contact and the movable contact via the conductive layer interposed therebetween. The conductive layer may be configured to be formed of a material more flexible than the fixed contact and fixed to the surface of the fixed contact or the surface of the movable contact.

All features and advantages of the present disclosure will become apparent in the following detailed written description.

BRIEF DESCRIPTION OF THE DRAWINGS

The invention itself, as well as a preferred mode of use, farther objects, and advantages thereof, will best be understood by reference to the following detailed description of an illustrative embodiment when read in conjunction with the accompanying drawings, wherein:

FIG. 5 is a cross sectional view of a state in which the switch device illustrated in FIG. 3 is turned ON.

DETAILED DESCRIPTION

Figure 1:
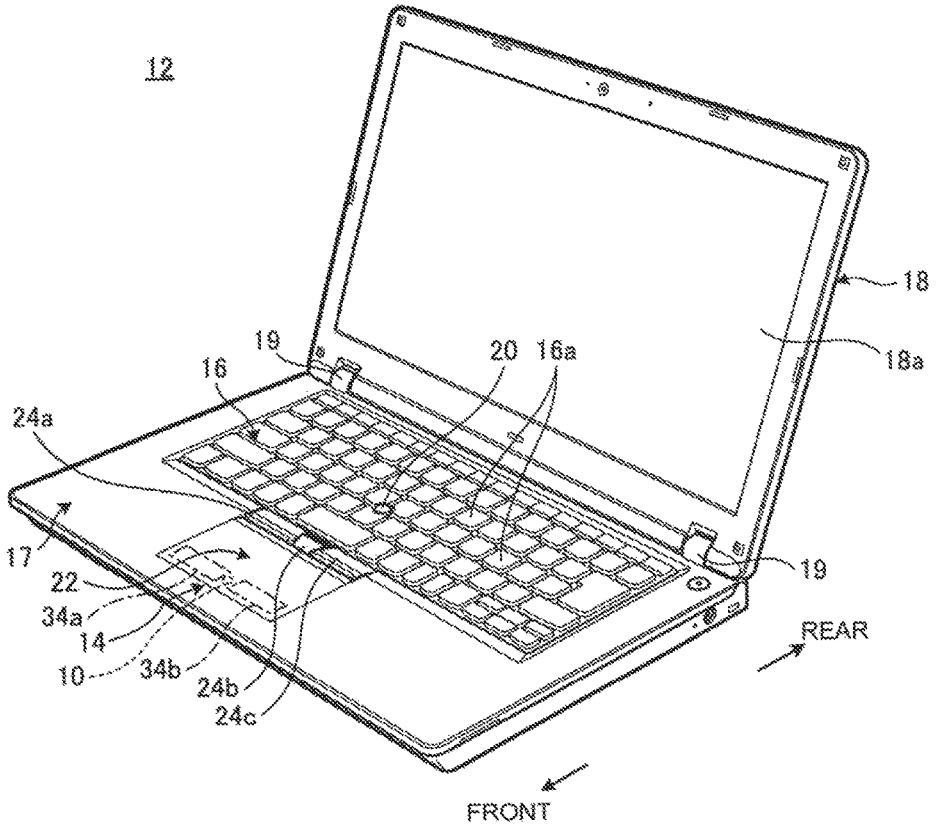
FIG. 1 is a perspective view of an electronic apparatus equipped with a switch device according to one embodiment of the present invention.
Figure 2:
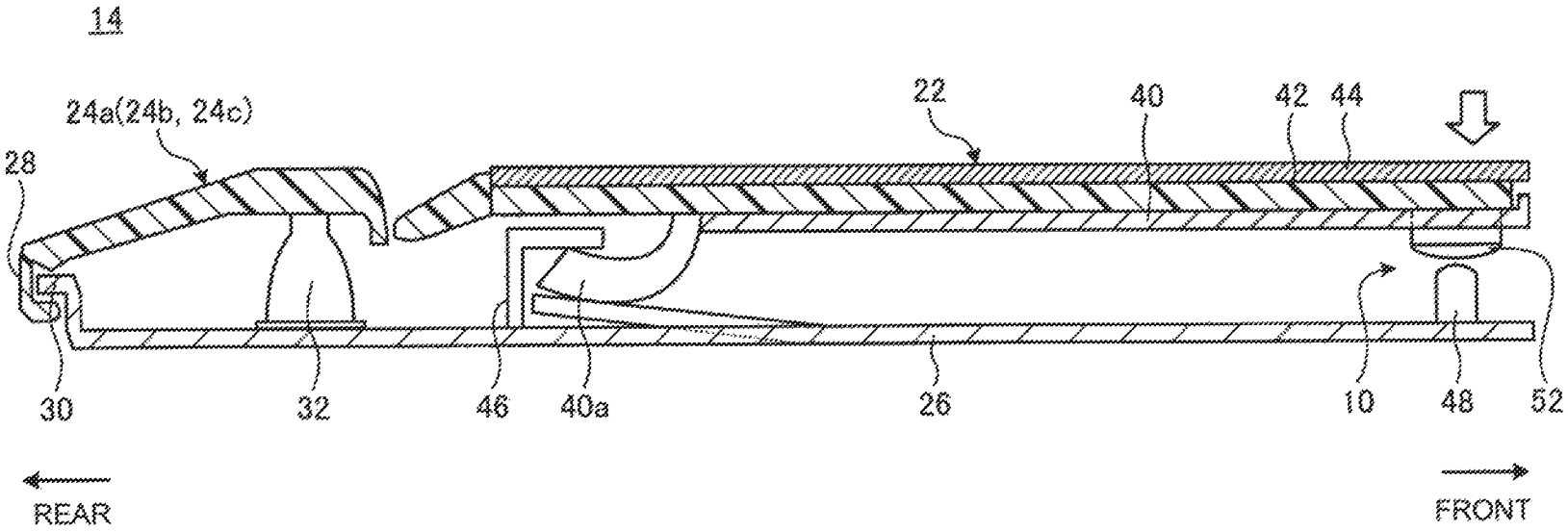
FIG. 2 is a cross sectional view of a touch pad device to which the switch device according to the one embodiment of the present invention is applied.

FIG. 1 is a perspective view of an electronic apparatus 12 equipped with a switch device 10 according to one embodiment of the present invention. FIG. 2 is a cross sectional view of a touch pad device 14 having the switch device 10 according to the one embodiment of the present invention is applied.

As illustrated in FIG. 1, the electronic apparatus 12 is a laptop PC equipped with a body chassis 17 having the touch pad device 14 and a keyboard device 16, and a display chassis 18 having a display device 18*a* such as a liquid crystal display or the like. The display chassis 18 is openably/closably coupled to the body chassis 17 by a pair of tight and left hinges 19.

Various electronic components such as a substrate, an arithmetic processing device, a hard disk device, a memory, etc, not illustrated in the drawing are contained within the body chassis 17. A pointing stick 20 is provided substantially in the center of the keyboard device 16. The pointing stick 20 is for operating a cursor (mouse pointer) displayed on the display device 18*a* and is an input part operable instead of a mouse.

The present embodiment exemplifies a configuration in which the switch device 10 is applied as a detection switch adapted to detect a depression operation relative to the touch pad device 14 of the electronic apparatus 12 that is such a laptop PC as described above. The switch device 10 may be used as a detection switch for detecting a depression operation of each keytop 16*a* of the keyboard device 16 and can be also utilized as detection switches or tact switches or the like for various push buttons provided in various electronic apparatuses such as a cellular phone, a smart phone, a tablet type PC, etc.

As illustrated in FIGS. 1-2, the touch pad device 14 is equipped with a touch pad 22 which receives a touch operation by approach or contact of a fingertip or the like, and three push buttons 24*a*, 24*b*, and 24*c* arranged along the rear edge portion of the touch pad 22. The touch pad 22 and the push buttons 24*a* to 24*c* are supported on the upper surface side of a base plate 26 which is a metal plate-like member.

The push buttons 24*a* to 24*c* function in cooperation with the cursor operation by the pointing stick 20 or the touch pad 22. They are respectively click operation buttons corresponding to a left button, a center button, and a right button of a general mouse. Each of the push buttons 24*a* to 24*c* is swingable with its rear end edge portion 28 as a fulcrum by rotatably engaging the rear end edge portion 28 with a support piece 30 formed upright at the rear end edge portion of the base plate 26 (refer to FIG. 2). Thus, when the front end side of each of the push buttons 24*a* to 24*c* is depressed, a rubber dome 32 arranged inside each push button is compressed, whereby an unillustrated detection switch such as a membrane switch provided on the upper surface of the base plate 26 is turned ON. A configuration similar to the switch device 10 to be described later may be used as a detection switch for these push buttons 24*a* to 24*c*.

The touch pad 22 is configured as a click pad capable of click operation by its depression operation in addition to the touch operation. Pseudo button areas 34*a* and 34*b* are set to the front side of the surface (operation surface) of the touch pad 22. The pseudo button areas 34*a* and 34*b* are provided to define their areas on the surface of the touch pad 22 by coordinates and are hence not capable of being visually recognized. When the touch pad 22 is depressed in a state in which the fingertip is made to contact with either of the pseudo button areas 34*a* and 34*b*, the switch device 10 is turned ON so that processing and displays corresponding to the pseudo button areas 34*a* and 34*b* are performed. For example, the two pseudo button areas 34*a* and 34*b* respectively correspond to the left and right buttons in the general mouse.

As illustrated in FIG. 2, the touch pad 22 is of a three-layered structure having a housing plate 40 which is a bottom face plate arranged to face the base plate 26, a substrate 42 that is laminated on the upper surface of the housing plate 40 and detects a touch operation to the touch pad 22, and a pad plate 44 laminated on the upper surface of the substrate 42.

The substrate 42 is of a substrate of a rectangular shape in a plan view, which is comprised of a glass epoxy resin or the like. The substrate 42 is capable of detecting a touch operation to the pad plate 44 and a depression operation to the touch pad 22 through the switch device 10. The substrate 42 is connected to a substrate in the body chassis 17 by unillustrated wires. Further, the substrate 42 is connected with unillustrated wires from the push buttons 24*a* to 24*c*. The pad plate 44 is of a glass plate or a resin plate of a rectangular shape in a plan view and is fixed to the upper surface of the substrate 42 by an adhesive or a double-sided tape, etc. The housing plate 40 is of a resin plate of a rectangular shape in a plan view and holds the substrate 42 and the pad plate 44.

By rotatably engaging a claw portion 40*a* provided on the rear end side of the housing plate 40 with a support piece 46 formed by cutting and erecting the upper surface of the base plate 26, the touch pad 22 is made swingable relative to the base plate 26 with its engagement portion as a fulcrum.

As illustrated in FIG. 2, the switch device 10 is arranged on the lower surface of a front end central portion of the substrate 42. When the touch pad 22 (substrate 42) is depressed and lowered, the switch device 10 is pressed and turned ON by a pressing protrusion 48 provided on the upper surface of the base plate 26 to transmit a prescribed detection signal.

The configuration and operation of the switch device 10 will be described.

Figure 3:
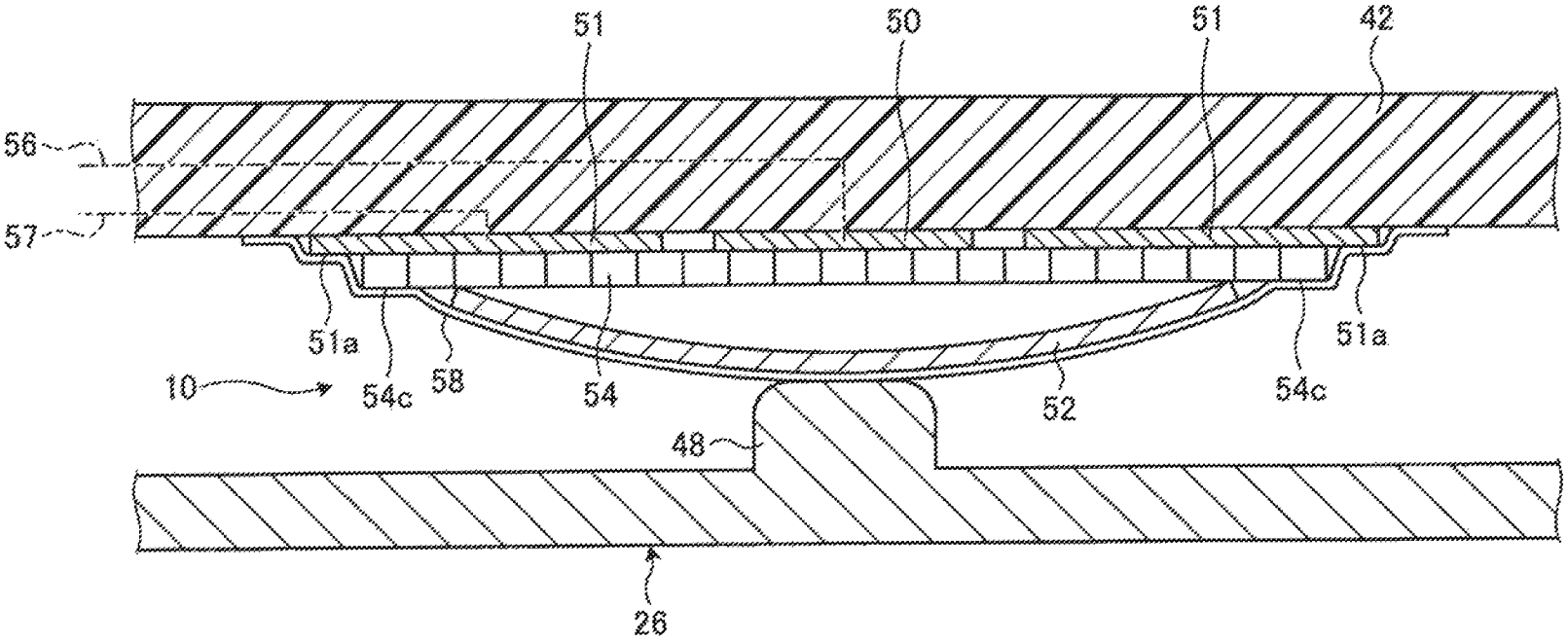
FIG. 3 is a cross sectional view of the switch device.
Figure 4:
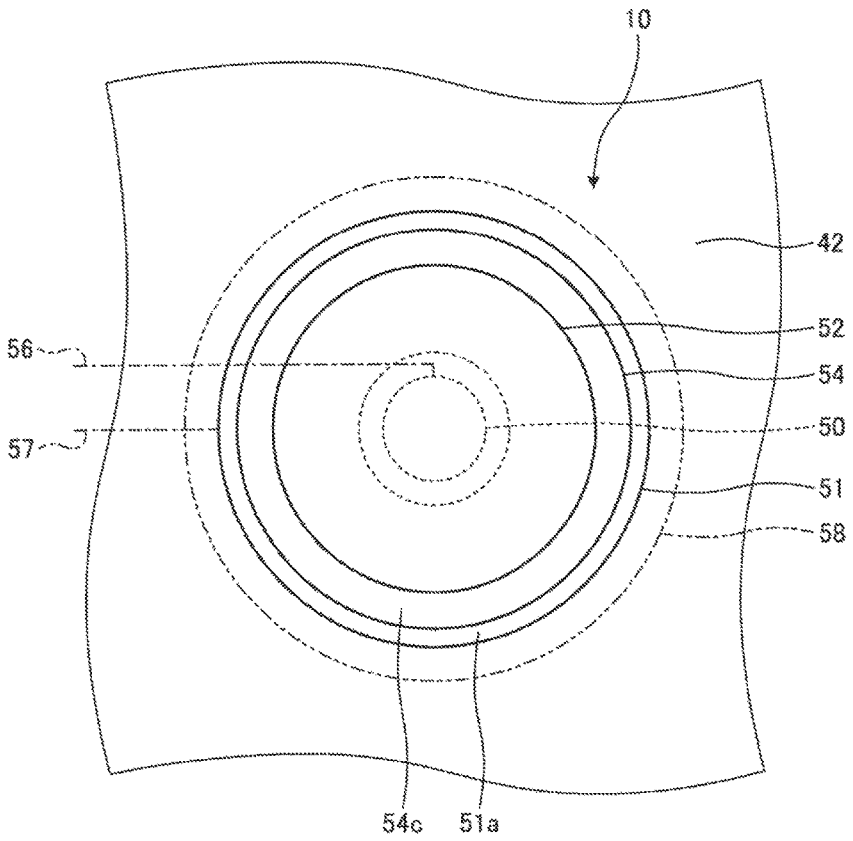
FIG. 4 is a top view of the switch device from FIG. 3.
Figure 5:
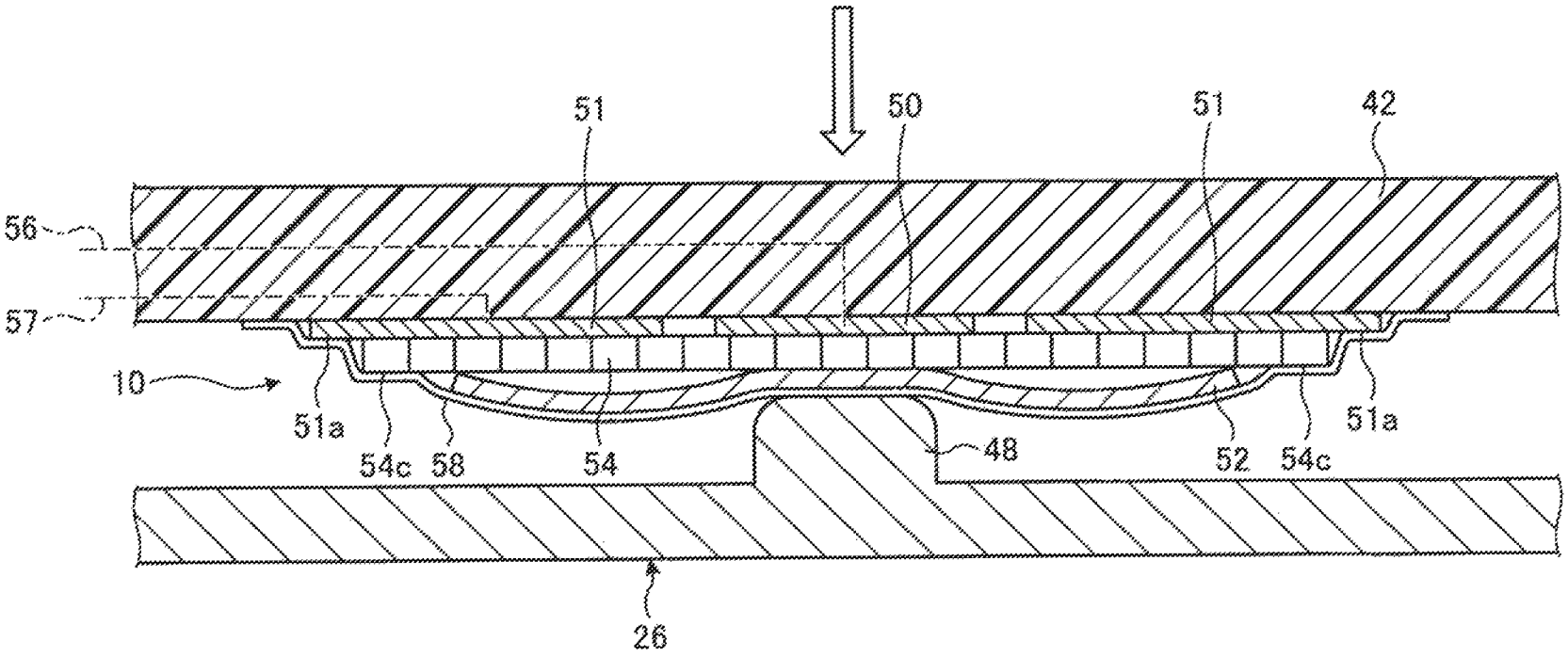

FIG. 3 is a cross sectional view of the switch device 10, and FIG. 4 is a top view of the switch device 10 illustrated in FIG. 3. Also, FIG. 5 is a cross sectional view of a state in which the switch device 10 illustrated in FIG. 3 is turned ON.

As illustrated in FIGS. 3-4, the switch device 10 is equipped with a first fixed contact (fixed contact) 50 and a second fixed contact 51 provided at the substrate 42, a metal dome (movable contact) 52 which is elastically deformed to thereby electrically connect between the first fixed contact 50 and the second fixed contact 51, and a conductive layer 54 provided so as to cover the surface of the first fixed contact 50 and a part of the surface of the second fixed contact 51.

The first fixed contact 50 is a circular contact electrode arranged on the substrate 42. The second fixed contact 51 is a circular and annular contact electrode provided so as to surround the outer periphery of the first fixed contact 50 at a position away from the first fixed contact 50 on the substrate 42. These first and second fixed contacts 50 and 51 are respectively of, for example, a metal conductor such as a copper foil, a copper plating film or the like.

Conductive wires 56 and 57 respectively connected to the first fixed contact 50 and the second fixed contact 51 are electrically separated from each other in a state (switch-OFF state) in which the metal dome 52 is not elastically deformed as illustrated in FIG. 3. On the other hand, the first fixed contact 50 and the second fixed contact 51 are electrically connected therebetween by the metal dome 52 in a state (switch-ON state) in which as illustrated in FIG. 5, the metal dome 52 is depressed and elastically deformed and thereby inverted, whereby the conductive wires 56 and 57 are electrically connected therebetween so that a prescribed ON signal is transmitted.

The metal dome 52 is of a dome-shaped disc spring capable of elastic deformation and is formed by a thin plate of a metallic material having spring characteristics, such as stainless steel, beryllium steel, phosphor bronze or the like. The metal dome 52 is arranged on the substrate 42 so as to separate its central part from the first fixed contact 50 and cover the first fixed contact 50 in a state in which its outer peripheral edge portion is electrically contact-arranged with the second fixed contact 51 through the conductive layer 54. The metal dome 52 is not necessarily required to be formed of a metal as a whole, and may be, for example, a configuration in which a metal thin film or the like is formed on the inner surface of an elastically deformable resin formed in a dome shape.

The metal dome 52 is elastically deformed and inverted by being pressed by the pressing protrusion 48 from the state illustrated in FIG. 3. Thus, as illustrated in FIG. 5, the inner surface of the central part of the metal dome 52 is electrically connected to the first fixed contact 50 through the conductive layer 54, whereby the first fixed contact 50 and the second fixed contact 51 are electrically connected therebetween. On the other hand, when a pressing force from the pressing protrusion 48 is released, the metal dome 52 is restored to the state illustrated in FIG. 3 again.

The conductive layer 54 is formed of at least a material more flexible than the first fixed contact 50 or the metal dome 52, e.g., a material having a hardness of one tenth or less as compared with copper forming the first fixed contact 50. The conductive layer 54 serves as a cushion material (soundproof material) which absorbs a collision sound when the metal dome 52 is elastically deformed and brought into contact with the first fixed contact 50. The conductive layer 54 is fixed onto the surfaces of these first and second fixed contacts 50 and 51 by adhesion or the like so as to extend from the surface of the first fixed contact 50 to the part of the surface of the second fixed contact 51. Therefore, the conductive layer 54 has insulation between the first fixed contact 50 and the second fixed contact 51 to thereby make is possible to avoid short-circuiting at the normal time and needs to have characteristics having sufficient conductivity among the metal dome 52, the first fixed contact 50 and the second fixed contact 51.

Figure 6:
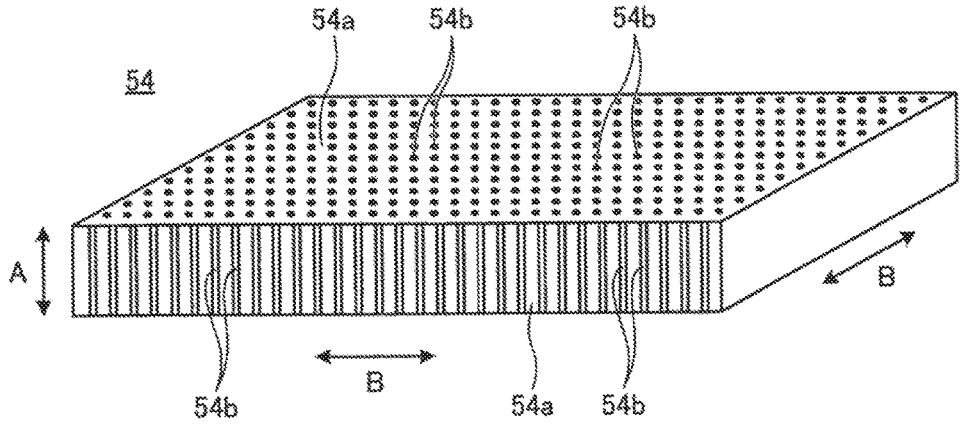
FIG. 6 is a perspective view of an anisotropic conductive sheet.

Therefore, in the switch device 10, as illustrated in FIG. 6, for example, an insulative resin material 54*a* is formed in a sheet-like shape, and metallic thin wires 54*b* extending thereinside in a thickness direction thereof are arranged in a plural form, thus configuring the conductive layer 54 by an anisotropic conductive sheet having no conductivity in its in-plane direction B while having conductivity in its thickness direction (out-plane direction) A. As a result, no short circuit occurs between the first fixed contact 50 and the second fixed contact 51 in the switch-OFF state illustrated in FIG. 3, and the first fixed contact 50 and the second fixed contact 51 are electrically connected therebetween through the conductive layer 54 and the metal dome 52 in the switch-ON state illustrated in FIG. 5. A carbon fiber or the like may be used instead of the metallic thin wires 54*b*.

As illustrated in FIGS. 3-4, in the switch device 10, the conductive layer 54 extends to a position where it protrudes more outward than the outer peripheral edge portion of the metal dome 52. Further, the metal dome 52 and a portion 54*c* of the conductive layer 54, which protrudes more outward than the outer peripheral edge portion of the metal dome 52, are pressed on the substrate 42 by a sheet (sheet-like member) 58. The sheet 58 is an insulative film formed of, for example, polyester or the like. The sheet 58 is a protection sheet which is adhered by an adhesive applied to the inner surface thereof to the metal dome 52, the portion 54*c* of the conductive layer 54, and the portion 51*a* of the second fixed contact 51, which protrudes more outward than the outer peripheral edge portion of the conductive layer 54, and presses these on the substrate 42.

In such a switch device 10, when the touch pad 22 is depressed to lower the substrate 42, the metal dome 52 is pressed by the pressing protrusion 48 so that the first fixed contact 50 and the second fixed contact 51 are electrically connected therebetween (refer to FIG. 5). As a result, the switch device 10 is brought into the switch-ON state so that an ON signal corresponding to each of the pseudo button areas 34*a* and 34*b* of the touch pad 22 is transmitted. On the other hand, when the depression operation to the touch pad 22 is released, the metal dome 52 is restored to its original dome shape again and hence the switch device 10 is brought into the switch-OFF state.

As described above, the switch device 10 according to the present embodiment is equipped with the first fixed contact 50 and the second fixed contact 51 which serve as the fixed contacts, and the metal dome 52 which serves as the movable contact movable in the direction to be contacted with or separated from the first fixed contact 50 as one of the fixed contacts. In the configuration thereof that the metal dome 52 and the first fixed contact 50 are electrically contacted with or separated from each other by moving the metal dome 52 and thereby the first fixed contact 50 and the second fixed contact 51 are electrically connected therebetween, the conductive layer 54 is provided between the first fixed contact 50 and the movable contact.

Thus, the generation of sound by collisions between metals between the metal dome 52 and the first fixed contact 50 when the metal dome 52 is depressed can be absorbed and prevented by the conductive layer 54 interposed therebetween. The generation or noise at the switch-ON can be suppressed. Since, at this time, the conductive layer 54 is formed of the resin as the material more flexible than the first fixed contact 50 and fixed to the surface of the first fixed contact 50, the generation of the collision sound between the metal dome 52 and the first fixed contact 50 can be more reliably suppressed by the conductive layer 54.

In the switch device 10, the conductive layer 54 is the anisotropic conductive sheet having the characteristics having no conductivity in its in-plan direction B while having conductivity in its thickness direction A. The anisotropic conductive sheet is arranged so as to cover the first fixed contact 50 and at least part of the second fixed contact 51. The metal dome 52 has the outer peripheral edge portion which is arranged electrically in contact with the second fixed contact 51 through the anisotropic conductive sheet.

By using the anisotropic conductive sheet as the conductive layer 54 in this manner, the conductive layer 54 can be provided over the surfaces of the first fixed contact 50 and the second fixed contact 51 required to be insulated in the switch-OFF state. Therefore, as compared with the case where the conductive layer 54 is provided only at the first fixed contact 50 generally formed in an extremely small size, the work of arranging the conductive layer 54 becomes easy, and hence efficiency in manufacturing the same is enhanced. On the other hand, since the conductive layer 54 being the anisotropic conductive sheet has the high conductivity in its thickness direction A, the conduction between the metal dome 52 and the first fixed contact 50 and the conduction between the metal dome 52 and the second fixed contact 51 are secured.

Further, the conductive layer 54 is interposed even between the outer peripheral edge portion of the metal dome 52 and the second fixed contact 51. Thus, the transfer of vibrations or raffling generated when the metal dome 52 is elastically deformed to the second fixed contact 51 can be suppressed by the conductive layer 54, and hence the generation of noise can be further suppressed. There may be adopted a configuration in which the outer shape of the conductive layer 54 is formed to be smaller than the outer shape of the metal dome 52, and the metal dome 52 is disposed directly on the second fixed contact 51 in contact therewith.

The conductive layer 54 extends to the position where it protrudes more outward than the outer peripheral edge portion of the metal dome 52. The metal dome 52 and the portion 54*c* of the conductive layer 54, which protrudes more outward than the outer peripheral edge portion of the metal dome 52 are pressed on the substrate 42 by the sheet 58. Thus, since the metal dome 52 and the conductive layer 54 can be simultaneously adhered and held by the sheet 58, it is possible to prevent the metal dome 52 from being displaced and rattled on the conductive layer 54. Also, during manufacture, the metal dome 52 and the conductive layer 54 can be arranged on the substrate 42 (first fixed contact 50 and second fixed contact 51) as a parts assembly in which they are adhered to and held on the inner surface of the sheet 58, and the manufacturing efficiency thereof is also improved.

Using such a switch device 10 as the detection switch adapted to detect the depression operation relative to the touch pad 22 which receives the touch operation, or the detection switch adapted to detect the depression operation relative to the keytop 16*a* of the keyboard device 16 makes it possible to suppress the generation of noise from these detection switches high in use frequency and achieve an effective sound reduction of the electronic apparatus 12.

Figure 7:
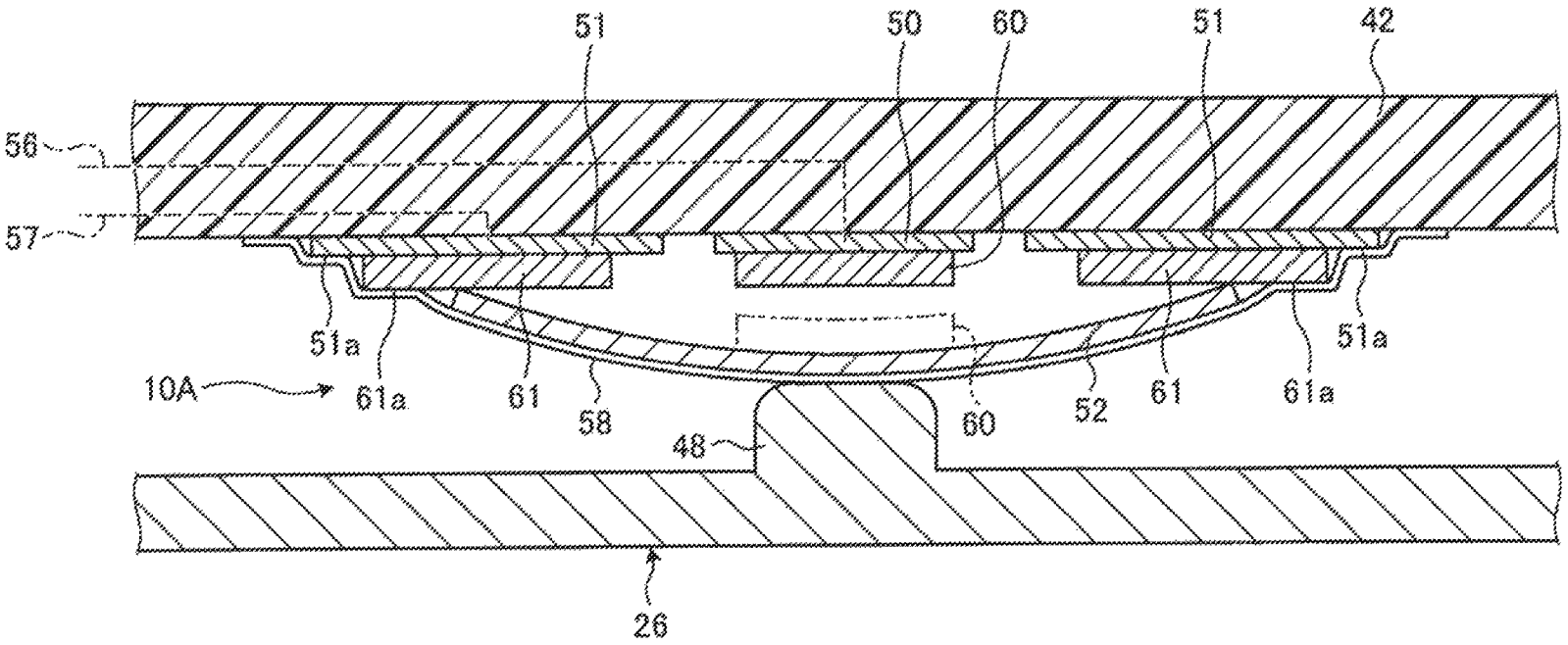
FIG. 7 is a cross sectional view of a switch device according to a first modification.

FIG. 7 is a cross sectional view of a switch device 10A according to a first modification. As illustrated in FIG. 7, in the switch device 10A, conductive layers 60 and 61 each formed of a conductive material are used instead of the conductive layer 54 formed of the anisotropic conductive sheet. Each of the conductive layers 60 and 61 is, for example, a cushion material which is formed in a sheet shape, of a conductive resin in which a conductive filer or the like such as carbon is added to a resin material, and formed of at least a material more flexible than a first fixed contact 50 or a metal dome 52.

Since, however, the conductive layers 60 and 61 formed of such a conductive material do not have characteristics like the characteristics of the anisotropic conductive sheet and have conductivity in all directions, the first fixed contact 50 and a second fixed contact 51 are always short-circuited therebetween where they are provided so as to cover the first fixed contact 50 to the second fixed contact 51 together. Therefore, in the switch device 10A, the conductive layers 60 and 61 are individually arranged at the surface of the first fixed contact 50 and the surface of the second fixed contact 51 so as to be separated from each other respectively. Further, the conductive layer 61 provided at the second fixed contact 51 extends to a position where it protrudes more outward than the outer peripheral edge portion of the metal dome 52. The metal dome 52 and a portion 61*a* of the conductive layer 61, which protrudes more outward than the outer peripheral edge portion of the metal dome 52 are pressed on a substrate 42 by a sheet 58.

The conductive layers 60 and 61 may be formed by fixing a conductive material formed in a sheet shape onto the surface of the first fixed contact 50 and the surface of the second fixed contact 51 by adhesion or the like or by printing (applying) a conductive material on the surface of the first fixed contact 50 and the surface of the second fixed contact 51 by silk screen printing or ink jet printing or the like. Instead of providing the conductive layer 60 on the surface of the first fixed contact 50, the conductive layer 60 may be provided on the inner surface of the central part of the metal dome 52 as indicated by a two-dot chain line in FIG. 7.

Thus, even in such a switch device 10A, sound by collisions between the metal dome 52 and the first fixed contact 50 is absorbed by the conductive layer 60, and hence the generation of noise is suppressed. Further, the transfer of vibrations or rattling generated at the elastic deformation of the metal dome 52 from its outer peripheral edge portion to the second fixed contact 51 can be suppressed by the conductive layer 61 interposed between the outer peripheral edge portion and the second fixed contact 51.

Figure 8:
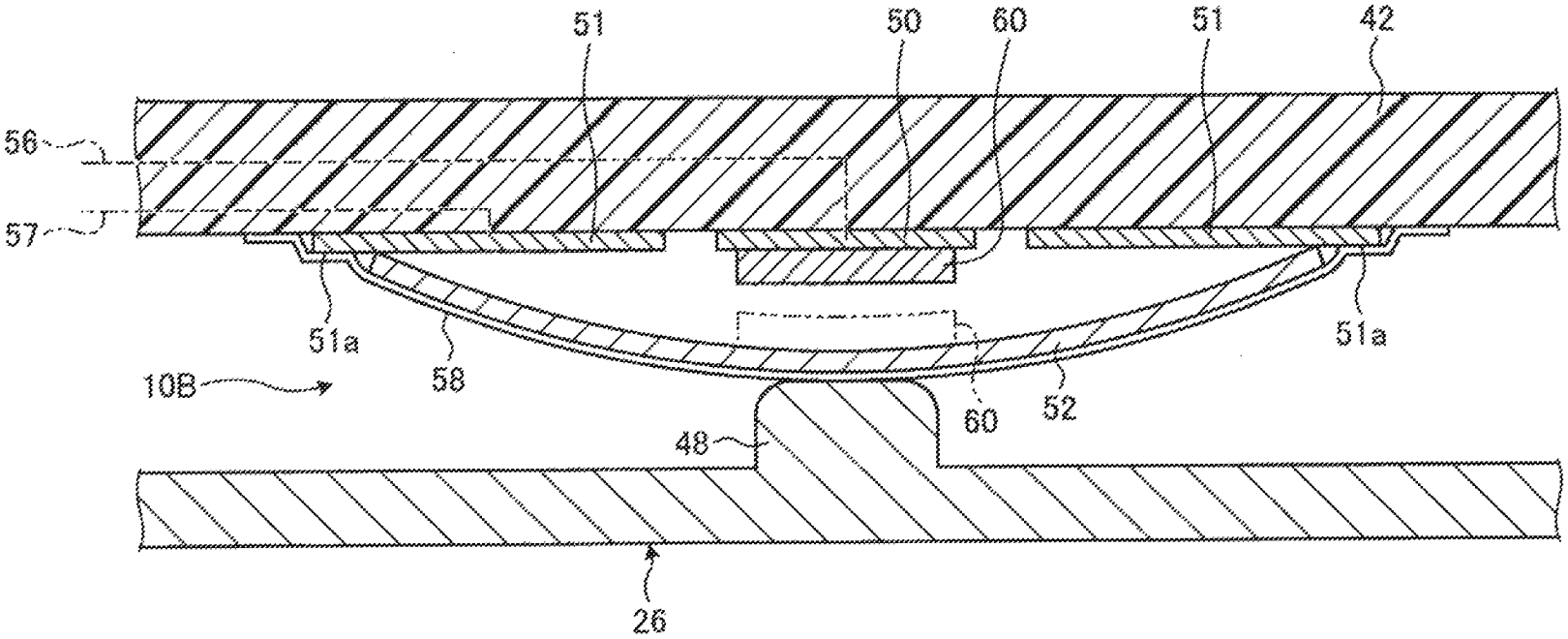
FIG. 8 is a cross sectional view of a switch device according to a second modification.

FIG. 8 is a cross sectional view of a switch device 10B according to a second modification. As illustrated in FIG. 8, the switch device 10B has a configuration in which the conductive layer 61 provided on the second fixed contact 51 of the switch device 10A illustrated in FIG. 7 is omitted, and the outer peripheral edge portion of the metal dome 52 is directly arranged on the second fixed contact 51. Thus, even in such a switch device 10B, sound by collisions between the metal dome 52 and the first fixed contact 50 is effectively absorbed by the conductive layer 60, and hence the generation of noise is suppressed.

Figure 9:
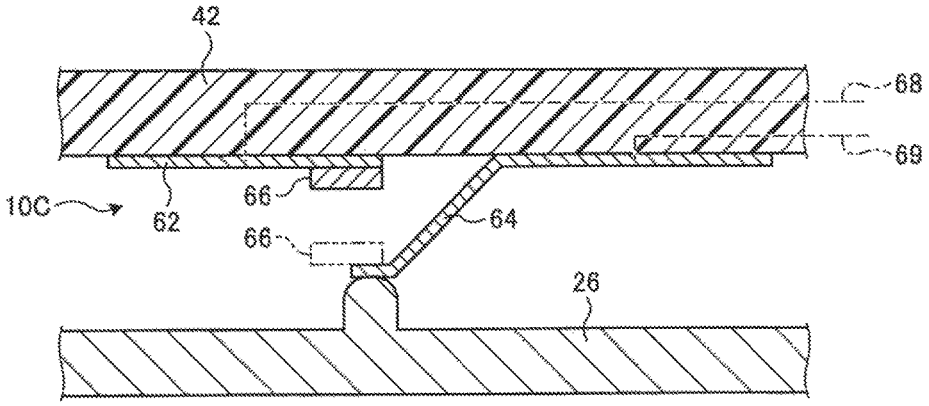
FIG. 9 is a cross sectional view of a switch device according to a third modification.

FIG. 9 is a cross sectional view of a switch device 10C according to a third modification. As illustrated in FIG. 9, the switch device 10C is equipped with a fixed contact 62 provided at a substrate 42, a movable contact 64 electrically connected to the fixed contact 62 by its elastic deformation, and a conductive layer 66 provided so as to cover the surface of the fixed contact 62.

The fixed contact 62 is a contact electrode arranged on the substrate 42, e.g., a metal conductor such as a copper foil, a copper plating film or the like. The movable contact 64 is an elastically-deformable plate spring-like member and is formed by bending a thin plate such as a copper plate, stainless steel or the like. The conductive layer 66 is one in which a conductive material formed in a sheet shape is fixed to the surface of the fixed contact 62 by adhesion or printing (application). Instead of providing the conductive layer 66 at the surface of the fixed contact 62, the conductive layer 66 may be provided at the tip inner surface of the movable contact 64 as indicated by a two-dot chain line in FIG. 9.

In the switch device 10C, conductive wires 68 and 69 respectively connected to the fixed contact 62 and the movable contact 64 are electrically separated from each other in a state in which the movable contact 64 is not elastically deformed as illustrated in FIG. 9 (switch-OFF state). On the other hand, in a state in which the movable contact 64 is elastically deformed (switch-ON state), the fixed contact 62 and the movable contact 64 are electrically connected therebetween, and the conductive wires 68 and 69 are also electrically connected therebetween. Thus, even in such a switch 10C, sound by collisions between the movable contact 64 and the fixed contact 62 is effectively absorbed by the conductive layer 66, and hence the generation of noise is suppressed.

As has been described, the present invention provides a switch device for an electronic apparatus.

While the invention has been particularly shown and described with reference to a preferred embodiment, it will be understood by those skilled in the art that various changes in form and detail may be made therein without departing from the spirit and scope of the invention.

What is claimed is:

1. A switch device comprising:

a first fixed contact separates from a second fixed contact;

an anisotropic conductive sheet directly contacts said first and second fixed contacts, wherein said anisotropic conductive sheet is electrically conductive in only one of its three dimensions; and a movable contact to be moved to contact said anisotropic conductive sheet in order to provide electrical conduction between said first fixed contact and said second fixed contact, wherein said moveable contact has an outer peripheral edge portion electrically coupled on said first fixed contact.

2. The switch device of claim 1, wherein said anisotropic conductive sheet is made of a flexible material.

3. The switch device of claim 1, wherein said anisotropic conductive sheet is made of an insulative resin material.

4. The switch device of claim 1, wherein said anisotropic conductive sheet contains thin metallic wires aligned within to provide electrical conductivity in only said one dimension.

5. The switch device of claim 1, wherein said movable contact has a metal dome formed in an elastically deformable dome shape and has an outer peripheral edge portion being arranged electrically in contact with said first fixed contact.

6. The switch device of claim 5, wherein said metal dome is covered by an insulative film on one surface.

7. The switch device of claim 5, wherein said metal dome is located opposite a pressing protrusion for pushing said metal dome.

8. The switch device claim 1, wherein said switch device is located between a housing plate and a base plate of a touch pad.

9. The switch device claim 1, wherein said first and second fixed contacts having one side directly contacts said anisotropic conductive sheet, and another side directly contacts a substrate.

10. The switch device claim 9, wherein said substrate is directly attached to a touch pad having a pseudo button area.

11. An electronic apparatus comprising:

a display chassis having a display device; and a body chassis having a keyboard and a touch pad, wherein said touch pad includes a switch device having a first fixed contact separates from a second fixed contact;

an anisotropic conductive sheet directly contacts said first and second fixed contacts, wherein said anisotropic conductive sheet is electrically conductive in only one of its three dimensions; and a movable contact to be moved to contact said anisotropic conductive sheet in order to provide electrical conduction between said first fixed contact and said second fixed contact, wherein said moveable contact has an outer peripheral edge portion electrically coupled on said first fixed contact.

12. The electronic apparatus of claim 11, wherein said anisotropic conductive sheet is made of a flexible material.

13. The electronic apparatus of claim 11, wherein said anisotropic conductive sheet is made of an insulative resin material.

14. The electronic apparatus of claim 11, wherein said anisotropic conductive sheet contains thin metallic wires aligned within to provide electrical conductivity in only said one dimension.

15. The electronic apparatus of claim 11, wherein said movable contact has a metal dome formed in an elastically deformable dome shape and has an outer peripheral edge portion being arranged electrically in contact with said first fixed contact.

16. The electronic apparatus of claim 15, wherein said metal dome is covered by an insulative film on one surface.

17. The electronic apparatus of claim 15, wherein said metal dome is located opposite a pressing protrusion for pushing said metal dome.

18. The electronic apparatus claim 11, wherein said first and second fixed contacts having one side directly contacts said anisotropic conductive sheet, and another side directly contacts a substrate.

19. The electronic apparatus claim 18, wherein said substrate is directly attached to said touch pad having a pseudo button area.

20. The electronic apparatus claim 11, wherein said switch device is located between a housing plate and a base plate of said touch pad.

* * * * *